United States Patent [19]

Allard et al.

[11] Patent Number: 4,534,735

[45] Date of Patent: Aug. 13, 1985

[54] FIRE SIMULATION DEVICE FOR TRAINING IN THE OPERATION OF SHOULDER WEAPONS AND THE LIKE

[75] Inventors: Jean-Claude Allard, Bourg la Reine; Rene Briard, Orgeval; Christian Saunier, Ermont, all of France

[73] Assignee: Giravions Dorand, Suresnes, France

[21] Appl. No.: 517,618

[22] Filed: Jul. 27, 1983

[30] Foreign Application Priority Data

Jul. 29, 1982 [FR] France ..... 82 13239

[51] Int. Cl.[3] ..... F41G 3/26

[52] U.S. Cl. ..... 434/20; 434/12

[58] Field of Search ..... 434/11, 12, 16–20, 434/23

[56] References Cited

U.S. PATENT DOCUMENTS

| | | | |
|---|---|---|---|
| 3,046,676 | 7/1962 | Hermann et al. | 434/12 |
| 4,209,832 | 6/1980 | Gilham et al. | 434/16 |
| 4,439,156 | 3/1984 | Marshall et al. | 434/12 |

*Primary Examiner*—Richard C. Pinkham
*Assistant Examiner*—Vincent A. Mosconi
*Attorney, Agent, or Firm*—Sprung Horn Kramer & Woods

[57] ABSTRACT

The simulation device provides training in the firing of rockets or guided missiles by means of a shoulder weapon. As soon as a shot is fired, the firer's field of view is occulted by a shutter. The aim at the instant of firing and the point of impact with respect to the target are displayed on an instructor's video screen. The target can be of a fictitious type generated by a computer and produced within the field of view of both the instructor and the firer at the same time. In the case of a real target, an index can be controlled by the instructor in order to locate the target and follow its progress up to the instant of firing. The result of the firing operation is judged according to the position of the point of impact with respect to the fictitious target or with respect to the index. The choice of the mode of operation is made on a control desk.

8 Claims, 7 Drawing Figures

FIRE SIMULATION DEVICE FOR TRAINING IN THE OPERATION OF SHOULDER WEAPONS AND THE LIKE

This invention relates to a simulation device for training in the operation of shoulder weapons such as those used for launching rockets or guided missiles, or for the operation of similar weapons.

Simulation devices for firing practice are already known and in widespread use. They serve to train and instruct firers by enabling them to practice aiming at a target either indoors or on an open range without actually making use of real projectiles. Thus the position of a fictitious projectile is defined by a computer and compared with the target position in order to judge the quality of a shot to be fired by determining in particular whether the aim is correct in order to guide the simulated projectile to impact on the target. These simulating devices are being constantly improved with a view to reproducing real firing conditions as effectively as possible, with the result that firers do not feel out of their element when they change from firing practice under simulated conditions to firing with real projectiles. Up to the present time, however, interest has mainly focused on training in the firing of guns from tanks, combat vehicles or other firing units of similar types. The known simulation devices are much less suitable in the case of shoulder weapons. The difference lies in the fact that in a real firing session with live ammunition, the firer remains in position in front of his weapon in the case of a tank gun whereas, in the case of shoulder weapons such as rocket launchers, the firer releases his hold on the weapon as soon as the shot has been fired and he may even leave it behind.

This invention meets a real need for fire-simulation devices which are of the above-mentioned type but are better suited to training requirements for the operation of rocket launchers, guided missile launchers or weapons of a similar type by providing the operator with conditions which are very close to those which he is likely to encounter under real firing conditions. With this objective, the invention proposes to provide the simulation device with occulting means actuated so as to conceal the firer's field of view as soon as the shot has been fired, thus preventing the firer from acquiring the objectionable habit of remaining in the same position in order to observe the result of his shot and thus become vulnerable to enemy counterfire.

The object of the invention is therefore to provide a simulation device for training in the operation of shoulder weapons and the like. The device comprises a weapon having a sighting line which can be oriented by the firer and fitted with an optical unit for providing the firer with a field of view comprising a firing ground and a target, and means for initiating fictitious firing of a projectile by the firer, means for transmitting an image of said field of view to an instructor station and for projecting said field of view onto a display screen, and a computer functionally connected to the optical unit for determining the position of impact of the projectile in the plane of the target. The simulator is distinguished by the fact that it comprises occulting means for concealing the field of view from the firer at the instant of firing a shot, and means for displaying the impact position with respect to the target on the display screen of the instructor station.

In the practical application of the device according to the invention, it is possible to use both a real target and a fictitious target. In the case of a real target, exercises take place on a firing ground or open range in which is placed a target usually consisting of a moving target. In the case of a fictitious target, the device comprises means for forming a fictitious target which appears in the firer's field of view and is superimposed on the firing ground. By way of example, these means can be of the type described in French patent Application No. 81 11574 filed by the present applicant on June 12, 1981. Said target-forming means serve to display a realistic, non-pointlike representation of a moving target in front of both the firer and the instructor. It will readily be understood that, in one case as well as in the other, the target is not necessarily a single target and the invention is equally applicable to exercises on multiple targets.

When a fictitious target is employed, the occulting means are advantageously arranged so as to ensure that said target appears in the firer's field of view at the same time as the firing ground but in such a manner as to allow said fictitious target to remain on the screen of the instructor station at the instant of cutoff of the firer's field of view. The instructor is thus enabled to judge the result of the shot fired according to the position occupied by the point of impact with respect to the fictitious target at the instant at which the fictitious projectile is supposed to reach the target plane. Only the firing ground disappears from his screen when the firer fires the shot and he can still see the point of impact and the fictitious target which are inserted on his display screen by electronic means controlled by the computer.

In the event that the target is a real target which is included in the firing ground and therefore disappears from the field of view at the same time as the ground, the device advantageously provides the instructor with a target-locating index which can be controlled from the instructor station and is displayed on the corresponding screen. An index of this type enables the instructor to follow the target as long as it remains visible in the projected image of the firer's field of view and then, after a shot has been fired and occultation or image cutoff has taken place, serves to retain an indication of the target position by means of said index which remains visible on the instructor's display screen. It is preferable to make use of an index which has a non-pointlike contour and can be controlled both in position and in dimensions.

Other features of the invention will be more apparent upon consideration of the following description and accompanying drawings, wherein.

Figure 5A:
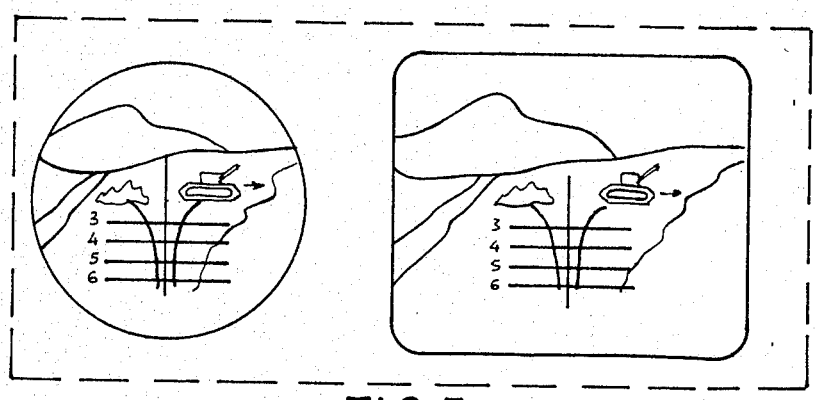
Figure 5B:
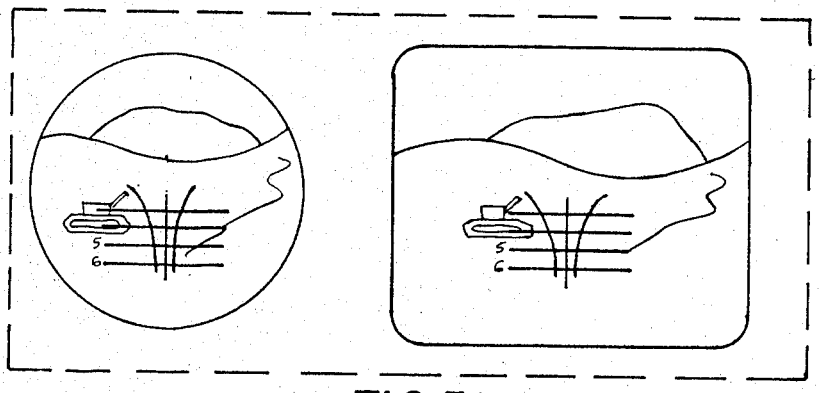
Figure 5C:
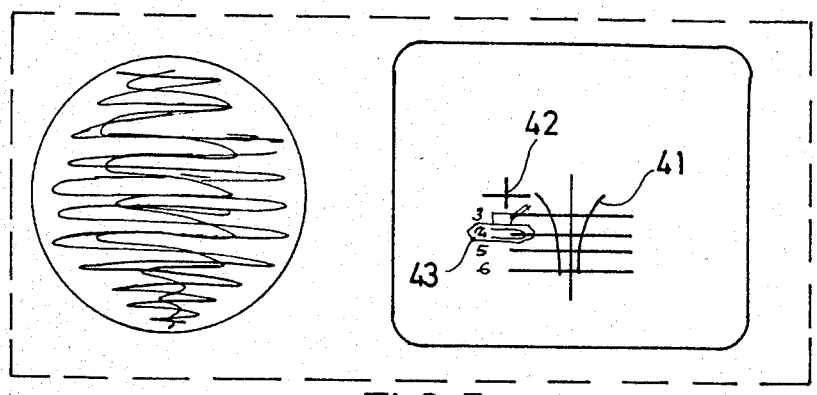

FIGS. 5*a*, 5*b*, 5*c* illustrate the operation of the simulator in this particular case.

Figure 1:
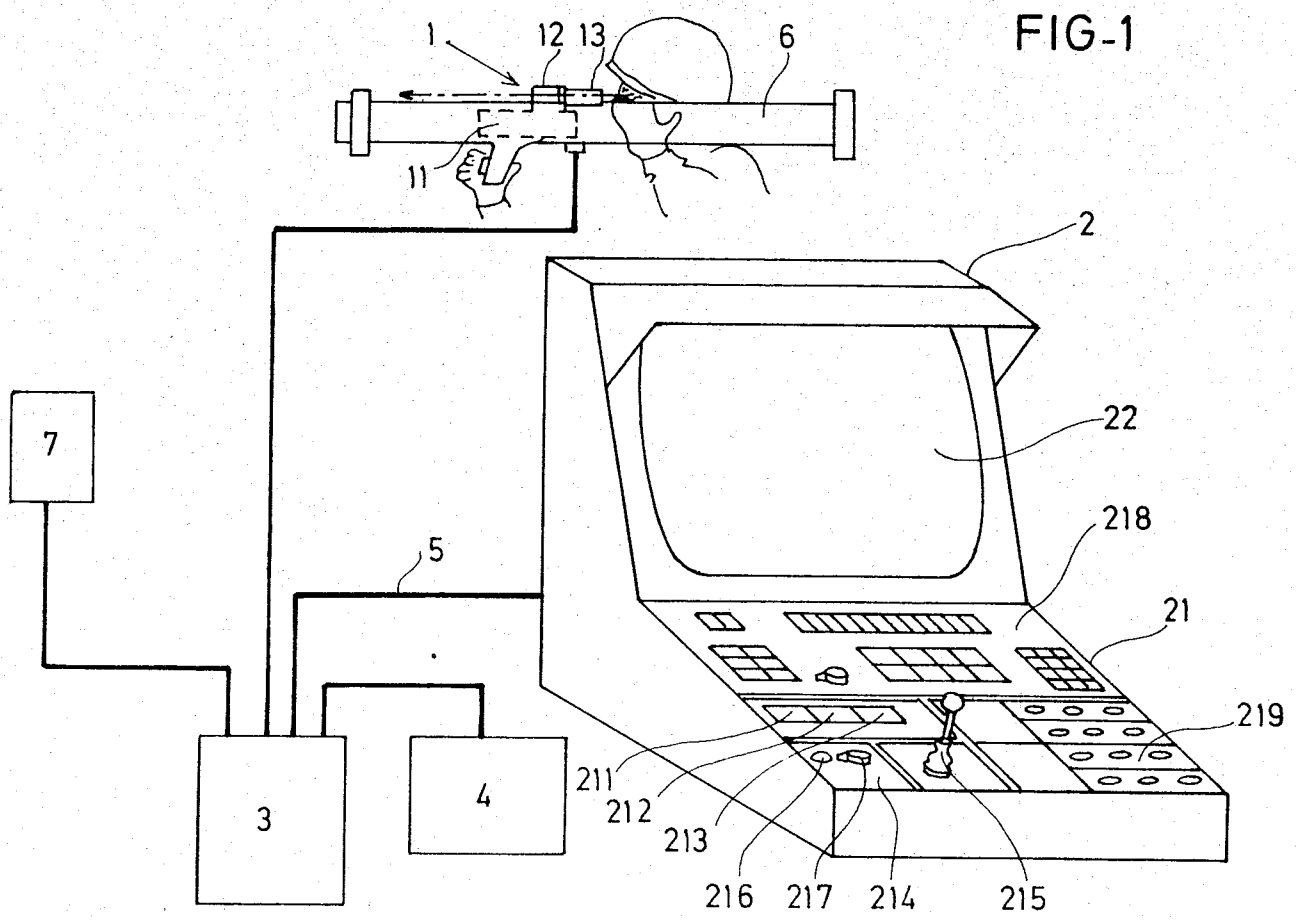
FIG. 1 is a general view showing the physical appearance of the simulation device.

FIG. 1 is a general view of a simulation device in accordance with the invention as employed for training in the firing of rockets from an antitank shoulder weapon. This weapon is illustrated in the form of a single rocket-launching tube 6 although it will be understood that the device could be equipped with a number of such tubes, depending on the number of firers to be trained during the same session. Moreover, the particular case under consideration is not intended to imply any limitation in regard to the type of weapon. In a more general sense, the tube 6 can be a projectile launcher and the projectile can be, for example, a missile as well as a rocket.

On the rocket-launching tube 6 is mounted an optical unit 1 consisting of two parts: an optoelectronic casing 11 placed within the launching tube and an optical casing 12 placed in front of the firer's eyepiece 13 and fixed on the internal portion of the optoelectronic casing 11.

A computer 3 comprising logic circuits based on microprocessors and interface analog circuits serves to control the optical unit 1 as well as a control desk 21 and a video screen 22 which constitute an instructor station 2. From this station, the instructor organizes firing exercises and evaluates the results.

A battery 4 delivers the supply current at a voltage of 27 volts. Said battery further comprises electronic circuits which make it possible either to charge it from the power supply system or to supply the simulator directly from the power system. By means of an anemometer 7 which is responsive to the force and to the orientation of wind and is located in front of the firing station in the direction of the target, cross-wind can be taken into account in calculations. Finally, cables 5 provide the necessary functional connections between the computer and the different elements.

Figure 2:
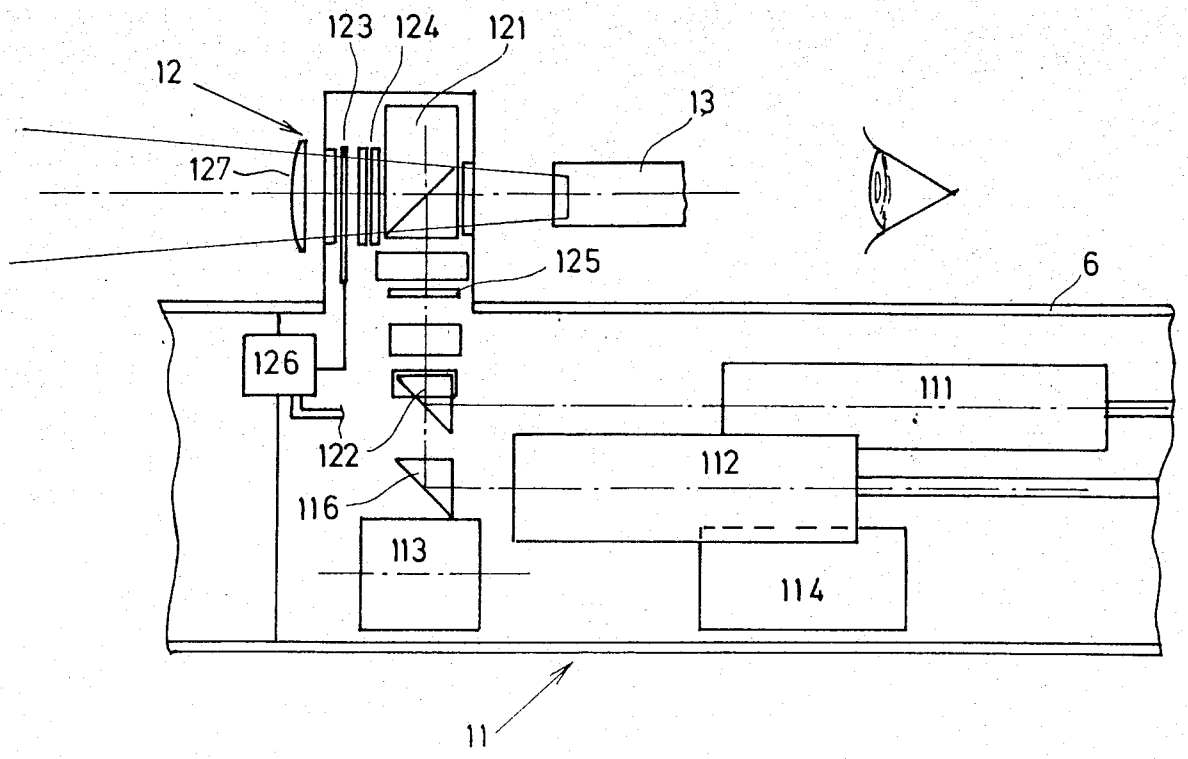
FIG. 2 is a top view showing the optical unit which is mounted on the weapon of the simulator.

FIG. 2 is a top view of the optical unit 1 which is integrated in the launching tube 6. Said optical unit 1 comprises different elements which have the function in the first place of enabling the firer to observe in the eyepiece 13 a field of view which includes the firing ground with or without a real target but provision being made for a fictitious target when required, a reticle being used to materialize the line of sight. In the second place, said elements have the function of transmitting an image of said field of view to the instructor station.

Within the optoelectronic casing 11, a device 111 for generating a synthetic image makes it possible to produce fictitious-target images under the control of the computer 3. In the particular case considered here, said image generator is of the flying-spot cathode-ray tube type described in French patent Application No. 81 11574 cited earlier and filed on June 12, 1981 in the name of the present applicant. The successive target images produced on the cathode-ray tube are transmitted to the optical casing 12 and the eyepiece 13 via a prism having a semi-reflecting surface 122 and a semi-reflecting plate 121 of said optical casing 12, both said prism and said plate being oriented at 45 degrees with respect to the optical path.

A video camera 112 is mounted within the optoelectronic casing 11 and located next to the image generator 111 in order to pick up the image of the optical field which is visible in the firer's eyepiece 13 and which is reflected to said camera from the semi-reflecting plate 121 and a prism 116 having a semi-reflecting surface. The image is retransmitted by the electronic equipment in order to be reproduced on the video screen 22 of the instructor station 2.

The optoelectronic unit further contains a gyroscope 113 which delivers items of information to the computer in regard to the movements which may be imparted to the weapon during operations in order to enable the computer to compensate for such movements in the calculations. Similarly, a tilt detector 114 which is also connected to the computer serves to correct the calculation of the impact point as a function of the angle of tilt.

Each element of the optoelectronic casing is intrinsically well-known to all those who are versed in the art and does not call for a more detailed description. The same also applies to the different optical elements of the optical casing 12.

Within said casing, provision is made in particular for the aforementioned semi-transparent plate 121 which is located in front of the object-lens of the eyepiece 13 and serves to transmit the image of the landscape to the firer with superimposition of the reflected images produced by the image generator 111. Said semi-transparent plate also serves to return all these images constituting the overall image of the firer's field of view to the video camera 112 through an automatically adjustable diaphragm 125. Two switchable grey filters 124 make it possible to attenuate the light intensity of the landscape.

The firer also sees in the eyepiece 13 a reticle related to the line of sight of the weapon. Said reticle can either be engraved on the inside of the eyepiece lens or projected above by conventional optical means, or else it can be produced by the image generator 111 under the control of the computer. The firer sees in addition a fictitious target which is generated by the device 111 and superimposed on the landscape.

In accordance with the invention, the optical unit further comprises an occulting diaphragm 123 or shutter actuated by a rotary element 126 which can be moved across the optical path in order to suppress the view of the landscape in the eyepiece 13 after simultaneous launching of the rocket. This displacement of the shutter 123 takes place under the control of an order which is emitted by the computer immediately as the firer initiates the shot by pressing on the trigger of his weapon. As placed in FIG. 2, said shutter always allows a person who is looking through the eyepiece to view the images produced by the image generator 111. In consequence, the arrangement illustrated is better suited to the use of a real target which is in that case completely obscured together with the landscape at the moment of occultation by the shutter 123. In an alternative embodiment, the shutter is moved so as to be located between the plate 121 and the eyepiece 13, with the result that the images produced by the generator 111, especially those representing a fictitious target, are concealed from the firer's view at the same time as the landscape and at the instant of occultation.

There is also shown in FIG. 2 a supplementary lens 127 placed in front of the optical casing 12. This lens is useful in the case of indoor training. It should indeed be noted that, whereas consideration has primarily been given in this description to outdoor training in front of a real firing ground or open range, the same device can be employed under similar conditions for indoor operation, in which case the firing ground is formed by a landscape image projected in the firer's field of view. By way of example, fixed images can be projected from diapositives or color transparencies in the case of a so-called fictitious target formed externally of the projector. Images can also be projected from a film which displays a moving target on a fixed background, the mode of operation in this particular instance being designated as "pseudo-real target practice".

Figure 3:
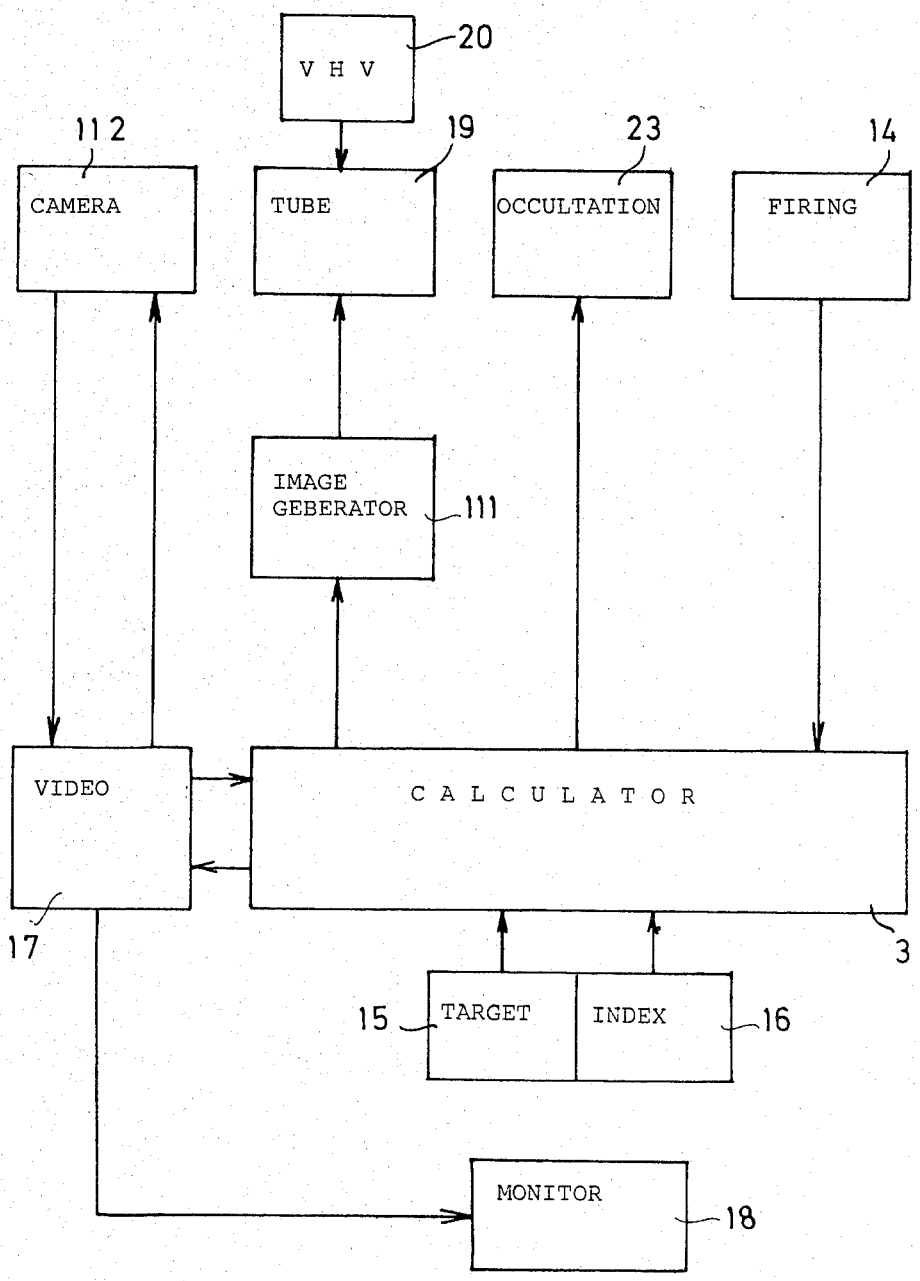
FIG. 3 is a block diagram of the essential electronic elements of the device.

In FIG. 3, it is more apparent that the computer 3 is functionally related to the elements of the firer station as shown in the upper portion of the figure and to those of the instructor station as shown in the lower portion of the figure. Thus, said computer receives information, mainly from the fire-initiating or launching device 14, from a control device 15 placed at the disposal of the instructor for generating a fictitious target, and from an index control device 16, the purpose of which will become apparent hereafter. Said computer also receives synchronization signals from an electronic video-control assembly 17, the function of which is to control the operation of the camera 112 and to carry out summation of the video signals received from the camera and from the computer in order to transmit said signals to the video monitor 18 which initiates visual display on the screen of the instructor station. Elements which have a more ancillary character and provide data for additional use in the calculations are not shown in the figure.

Furthermore, the computer emits orders as explained earlier, mainly in the direction of the image generator 111 which is shown together with its cathode-ray tube 19 and the very-high-voltage current supplied to this latter by means 20, but also in the direction of the occulting device 23 which comprises the shutter 123 and its driving motor 126. The computer also produces video insertion signals which are transmitted to the electronic assembly 17 for visual display of the corresponding information on the screen 22 of the instructor station. Finally, the computer 3 determines the point of impact of the simulated projectile in the plane of the target, primarily as a function of previously recorded characteristics of said projectile, of the target distance, and of the other parameters already mentioned.

Figure 4:
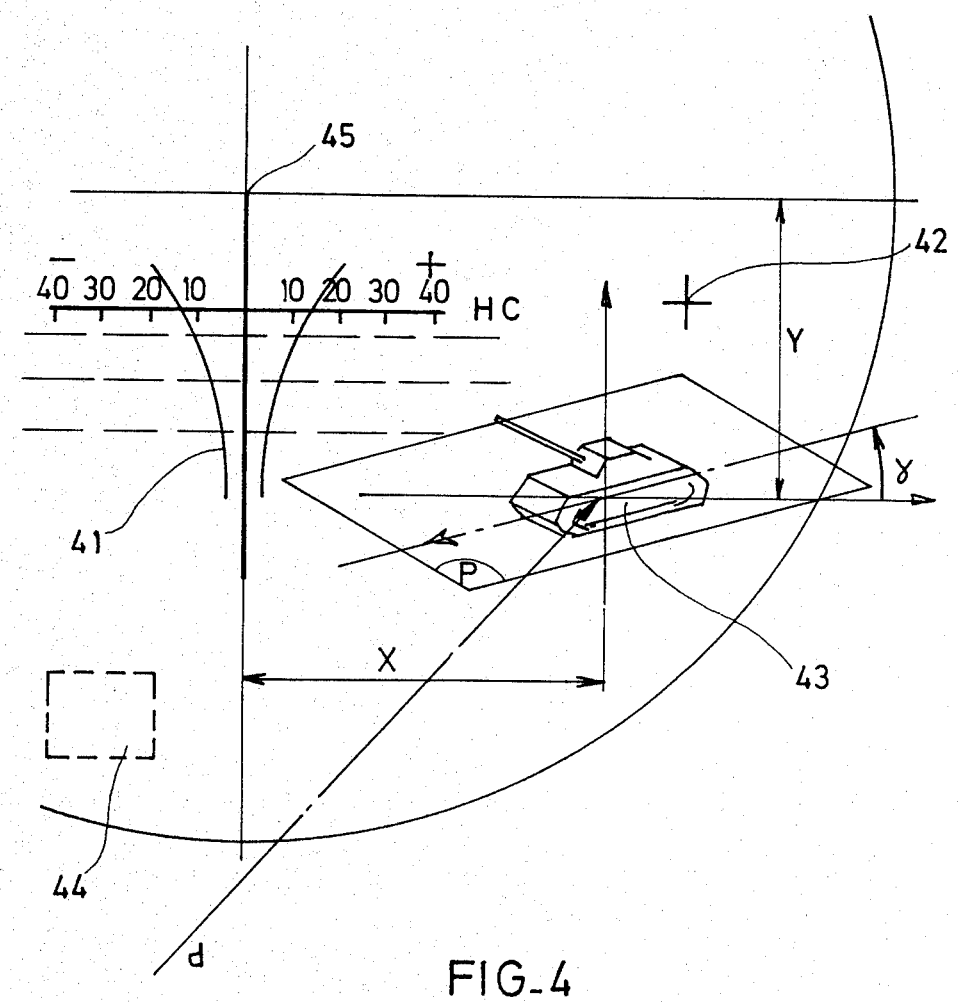
FIG. 4 is a schematic presentation of the image on the display screen of the instructor station.

FIG. 4 shows the indications which are displayed on the instructor's screen under the control of the video insertion signals. The figure does not show the landscape which is added to the display and is retransmitted from the firer's field of view, possibly with a real target which moves over the ground up to the moment of occultation. On the other hand, the figure does show the fictitious target 43 which appears on the display screen in the case of an operation involving the use of a fictitious target retransmitted by the camera 112 from the image generator 111. The video insertion signals contain the items of information required for visual display of a reticle 41 which is identical with the reticle sighted by the firer and is associated with the line of sight 45 in the same manner as this latter, of an index 44 determined by the instructor in the form of a rectangle which is variable in position and in dimensions in the case of operation with a real target, and of an impact cross 42 which characterizes the position of the impact point determined by the computer.

Further consideration will now be given to FIG. 1 in order to describe the control desk 21 of the instructor station 2 and to describe the procedure adopted by the instructor in order to select the different operating conditions and to carry out the different control operations, in particular by means of the devices 15 and 16 of FIG. 3, and by introducing into the computer 3 the parameters which are necessary for simulation.

A first section of the control desk 21 enables the instructor after turn-on (initiated by the computer) to choose between three functions, depending on whether he actuates an "initialization" key 211, a "fictitious target" key 212, a "real target" key 213. As a general rule, the instructor first selects the "initialization" key 211 since he has to check correct correspondence of origins. In point of fact, the origins or reference axes for generation of a fictitious target and video insertion of the sighting reticle must coincide with the origin of the reticle of the firer's eyepiece. To this end, the instructor utilizes the zone 219 of the control desk which enables him, by depressing the potentiometer push-buttons arranged in groups of three, first to align with the firer's eyepiece reticle a reference cross which is generated by the simulator and centered on a reference axis, and then to align with the cross the reticle which is inserted on his screen. The three potentiometers of each group make it possible to displace the corresponding image respectively along X, along Y and in rotation (FIG. 4).

In the case of a fictitious-target operating mode, the instructor can make use of the control-desk section 218 which enables him to record the parameters of a number of different fictitious targets prior to the instruction periods. By way of example, the following parameters can be recorded: a reference numeral, the distance d of the target at the instant of appearance, the speed of the target, its orientation in space with respect to the horizontal and vertical directions, its position along the axes X and Y with respect to the center of the field (still at the instant of appearance), the slope of the ground on which the target is moving, the light intensity of the target. The instructor can also modify the recorded linear path of travel of a given target during the exercise by producing action in real time on a control lever 215 which serves both to modify the target orientation as well as to vary the target velocity.

The section 214 of the control desk is employed in conjunction with the control lever 215 when the instructor has selected the mode of operation on a real target. In this operating mode, the computer generates the rectangular index 44 on the video screen. By means of the control lever 215, the instructor brings said index into a position in which it is superimposed on the target while observing this latter on the landscape which is retransmitted by the camera. At the same time, by regulating the potentiometers 216 and 217 as a function of the height of the target and of its width, he adjusts the size of the index in order to ensure that this latter corresponds to the dimensions of the target. By controlling said index, the instructor tracks the target until the shot is fired, thus permitting the computer to determine the distance, the position, the speed and the direction of displacement of the target at the moment of firing or launching from the variation in size, position and speed of the index.

The electronic circuits associated with the different elements of the simulator, in particular those of the control desk, are conventional and within the capacity of any one skilled in the art. They will therefore not be considered further in this description.

FIGS. 5*a*, 5*b*, 5*c* illustrate the operation of the simulator in the case of simulation on real ground with a fictitious target and show the successive stages of operation. Thus the left-hand side of each figure depicts the scene observed by the firer in the eyepiece and the right-hand side illustrates the scene which appears on the instructor's display screen.

First of all, the instructor provides the firer with a verbal indication of the position of appearance of the target (for example: "tank at the edge of the clump of trees on the right"). The firer prepares his weapon and directs it towards the point indicated. When the instructor considers that the firer is in fact aiming at the zone considered, he decides on the departure of the target by initiating the generation of a fictitious target, the parameters of which have been recorded by him beforehand (FIG. 5*a*). While the target is being followed by the firer, the instructor can modify the course of the target by displacing the control lever 215 and can thus complicate the firer's task in order to make him accustomed to guard against undue reliance on any apparent ease of pursuit.

While the firer is pointing his weapon (FIG. 5*b*), the instructor assesses the accuracy of his aim by means of the eyepiece reticle which is reproduced on the video monitor. When the firer estimates that his aim is correct, he initiates firing of the fictitious rocket. Firing of the shot produces an instantaneous displacement of the shutter of the optical unit which accordingly cuts off any further view of the landscape both for the firer and for the instructor, even in the case of the firer's view of the fictitious target (as shown in FIG. 5*c*). The firer then lays down his weapon and walks across to stand next to the instructor in front of the video screen in order to determine the result of his shot. They can both see on the screen the engraved sighting reticle 41, the fictitious target 43, the position of which has been "frozen", or arrested at the instant of firing delayed by the simulated time of travel of the rocket, and the impact cross 42 indicates the point of impact.

In the case of simulation of firing at a real target, the operation is substantially the same except for the fact that the target will disappear from the instructor's screen together with the landscape. It is for this reason that, in this instance, the computer generates the index 44 which will enable the instructor to follow the real target by means of the control lever up to the instant at which the firing of a shot initiates an occultation or image cutoff, and thus enables him to provide the computer with indications relating to the position of the target and the parameters of target displacement. The computer subsequently considers the target velocity as constant during travel of the fictitious projectile. In order to judge the result of the shot which has been fired, the instructor compares the position of the index 44 with the position of the cross 42 which represents the point of impact.

It will be readily apparent that the invention is not limited in any sense to the particular form of construction described in the foregoing and any modification within the capacity of those versed in the art also forms part of the invention.

We claim:

1. A simulation device for training in the operation of shoulder weapons or the like, comprising a weapon having a sighting line which can be oriented by the firer and is fitted with an optical unit for providing the firer with a field of view comprising a firing ground and a target, and means for initiating fictitious firing of a projectile by the firer, means for transmitting an image of said field of view picked up through the optical unit to an instructor station and for projecting said field of view on to a display screen, and a computer functionally connected to the optical unit for determining the position of impact of the projectile in the plane of the target, wherein said simulation device comprises means for displaying either a target locating contour in superimposition on an image of the target displayed on the instructor screen or a fictitious target on the instructor screen, occulting means for concealing the field of view from the firer at the instant of firing a shot while allowing the display target to remain on the screen of the instructor station at the time of occultation of the firer's field of view, and means for displaying the impact position with respect to the target on the display screen of the instructor station.

2. A device in accordance with claim 1, wherein the means for displaying on said screen a target locating contour can be controlled from the instructor station to follow the movements of the target and indicate the location of the target at the instant of firing a shot.

3. A device according to claim 2, wherein the target locating contour has a size in relationship with the target dimensions and wherein said contour can be controlled in positions and in dimensions from the instructor station, to follow the modifications of the dimensions of the image of the target displayed on the instructor screen due to the movement of the target in the landscape.

4. A device according to claim 1 or claim 2, wherein said device comprises means for forming a fictitious target which appears in the firer's field of view and is superimposed on the firing ground, to constitute on the instructor screen the fictitious displayed target.

5. A device according to claim 1, wherein the instructor station is provided with means for controlling the fictitious target at least in position, orientation and dimensions on the display screen.

6. A device in accordance with claim 5 wherein the instructor station is provided with a control desk comprising means enabling the instructor to choose between at least two operating modes, in one case with a real target forming part of a landscape observed by the firer and in the other case with a fictitious target superimposed on said landscape.

7. A device in accordance with claim 6, wherein the control desk is provided with means for recording in the computer memory the characteristics of a plurality of fictitious targets and their respective displacements.

8. A device in accordance with claim 6, characterized in that the instructor station comprises control means for aligning a cross produced by image-generating means on the reticle of the firer's field of view and the reticle inserted on the screen of the instructor station with the alignment cross reproduced on said screen.

* * * * *